US009889504B2

(12) United States Patent
Weiss et al.

(10) Patent No.: US 9,889,504 B2
(45) Date of Patent: Feb. 13, 2018

(54) POROUS NANOMATERIALS HAVING THREE-DIMENSIONAL PATTERNING

(71) Applicant: Vanderbilt University, Nashville, TN (US)

(72) Inventors: Sharon M. Weiss, Franklin, TN (US); Judson D. Ryckman, Nashville, TN (US); Yang Jiao, Nashville, TN (US)

(73) Assignee: Vanderbilt University, Nashville, TN (US)

( * ) Notice: Subject to any disclaimer, the term of this patent is extended or adjusted under 35 U.S.C. 154(b) by 0 days.

(21) Appl. No.: 14/103,811

(22) Filed: Dec. 11, 2013

(65) Prior Publication Data

US 2014/0255653 A1 Sep. 11, 2014

Related U.S. Application Data

(60) Provisional application No. 61/735,871, filed on Dec. 11, 2012, provisional application No. 61/849,111, filed on Jan. 18, 2013.

(51) Int. Cl.

| | |
|---|---|
| ***B32B 3/26*** | (2006.01) |
| ***B32B 3/30*** | (2006.01) |
| ***B22F 9/04*** | (2006.01) |

(52) U.S. Cl.

CPC ..... *B22F 9/04* (2013.01); *Y10T 428/24496* (2015.01)

(58) Field of Classification Search

CPC ..... G01N 21/658; G01N 21/62; G01N 21/65; B32B 3/26; B32B 3/263; B32B 3/30; B82Y 10/00; B82Y 5/00; B82Y 15/00; B21D 22/02; Y10T 428/24479; Y10T 428/24496; Y10T 428/249953; Y10T 428/249978; Y10T 428/249979

USPC ..... 428/158, 315.5, 315.7, 316.6, 304.4; 356/301; 977/810, 811

See application file for complete search history.

(56) References Cited

U.S. PATENT DOCUMENTS

| | | | |
|---|---|---|---|
| 5,017,007 | A | 5/1991 | Milne et al. |
| 5,468,606 | A | 11/1995 | Bogart et al. |
| 6,165,911 | A | 12/2000 | Calveley |
| 6,248,539 | B1 | 6/2001 | Ghadiri et al. |
| 7,027,163 | B2 | 4/2006 | Angeley |
| 7,195,733 | B2 | 3/2007 | Rogers et al. |

(Continued)

FOREIGN PATENT DOCUMENTS

| | | |
|---|---|---|
| WO | 2009062757 | 5/2009 |

OTHER PUBLICATIONS

Alexander, T.A. et al., "Characterization of a commercialized SERS-active substrate and its application to the identification of intact Bacillus endospores," Appl. Optics (2007) 46(18):3878-3890.

(Continued)

*Primary Examiner* — Joanna Pleszczynska

(74) *Attorney, Agent, or Firm* — Michael Best & Friedrich LLP

(57) ABSTRACT

Provided are methods for imprinting a porous material, the methods including applying a first stamp to a porous material having an average pore size of less than about 100 μm, the first stamp having at least a first portion having a first height, a second portion having a second height and a third portion having a third height, wherein the first height, second height and third height are different.

21 Claims, 9 Drawing Sheets

(56) References Cited

U.S. PATENT DOCUMENTS

| | | | | |
|---|---|---|---|---|
| 7,226,733 | B2 | 6/2007 | Chan et al. | |
| 7,271,896 | B2 | 9/2007 | Chan et al. | |
| 7,410,763 | B2 | 8/2008 | Su et al. | |
| 7,450,227 | B2 | 11/2008 | Dwight et al. | |
| 7,517,656 | B2 | 4/2009 | Martin et al. | |
| 7,582,486 | B2 | 9/2009 | Gollier et al. | |
| 7,618,250 | B2 | 11/2009 | Van Santen et al. | |
| 7,692,771 | B2 | 4/2010 | Kolesnychenko et al. | |
| 7,843,562 | B2 * | 11/2010 | Chan et al. | 356/301 |
| 8,349,617 | B2 | 1/2013 | Weiss et al. | |
| 8,932,475 | B2 | 1/2015 | Zu et al. | |
| 2005/0186515 | A1 | 8/2005 | Watkins | |
| 2005/0191419 | A1 | 9/2005 | Helt | |
| 2005/0246021 | A1 | 11/2005 | Ringeisen et al. | |
| 2006/0063178 | A1 | 3/2006 | Rauh Adelmann et al. | |
| 2006/0152147 | A1 | 7/2006 | Lee et al. | |
| 2007/0115469 | A1 | 5/2007 | Ebstein | |
| 2008/0157235 | A1 | 7/2008 | Rogers et al. | |
| 2008/0208351 | A1 | 8/2008 | Basenbacher et al. | |
| 2009/0093879 | A1 | 4/2009 | Wawro et al. | |
| 2009/0140458 | A1 | 6/2009 | Xu et al. | |
| 2009/0269587 | A1 | 10/2009 | Dressick et al. | |
| 2009/0273119 | A1 | 11/2009 | Imai | |
| 2009/0279085 | A1 | 11/2009 | Ebstein | |
| 2010/0001848 | A1 | 1/2010 | McAllister et al. | |
| 2010/0084376 | A1 | 4/2010 | Khusnatdinov et al. | |
| 2010/0106233 | A1 | 4/2010 | Grant et al. | |
| 2011/0056398 | A1 | 3/2011 | Weiss | |
| 2011/0059538 | A1 | 3/2011 | Weiss et al. | |
| 2013/0182249 | A1 | 7/2013 | Weiss et al. | |
| 2014/0043607 | A1 | 2/2014 | Wang et al. | |

OTHER PUBLICATIONS

Bok, H. M. et al., "Multiple surface plasmon modes for a colloidal solution of nanoporous gold nanorods and their comparison to smooth gold nanorods," Nano Lett. 8, 2265-2270 (2008).

Bosman, M. et al., "Light Splitting in Nanoporous Gold and Silver," ACS Nano 6, 319-326 (2012).

Chu, Y. et al., "Double-resonance plasmon substrates for surface-enhanced raman scattering with enhancement at excitation and stokes frequencies," ACS Nano (2010) 4:2804-2810.

Ciesielski , P.N. et al., "Functionalized nanoporous gold leaf electrode films for the immobilization of photosystem I," ACS Nano (2008) 2:2465-2472.

Cunin, F. et al., "Biomolecular screening with encoded porous-silicon photonic crystals," Nat. Mater. 1, 39-41 (2002).

Del Campo, A. et al., "Fabrication approaches for generating complex micro- and nanopatterns on polymeric surfaces," Chem Rev 108, 911-945 (2008).

Ding, Y. et al., "Nanoporous golf leaf: 'ancient technology'/advanced material," Adv. Mater. (2004) 16(21):1897-1900.

Freese, W. et al., "Design of binary subwavelength multiphase level computer generated holograms," Opt. Lett. 35, 676-678 (2010).

Fu, Y. Q. et al., "Diffractive optical elements with continuous relief fabricated by focused ion beam for monomode fiber coupling," Opt. Express 7, 141-147 (2000).

Gates, B. D. et al., "New approaches to nanofabrication: Molding, printing, and other techniques," Chem Rev 105, 1171-1196 (2005).

Geissler, M. et al., "Patterning: Principles and Some New Developments," Adv Mater 16, 1249-1269 (2004).

Gharghi, M. et al., "A Carpet Cloak for Visible Light," Nano Lett. 11, 2825-2828 (2011).

Guo, C. et al., "Grayscale photomask fabricated by laser direct writing in metallic nano-films," Opt. Express 17, 19981-19987 (2009).

Guo, L. J., "Nanoimprint Lithography: Methods and Material Requirements," Adv Mater 19, 495-513 (2007).

Hrudey, P.C.P. et al., "Variable diffraction gratings using nanoporous electrodes and electrophoresis of dye ions," Nanoengineering: Fabrication, Properties, Optics and Devices IV, edited by E.A. Dobisz et al., Proc. of SPIE (2007) 6645:66450K1-12.

Hsu, K. H. et al., Electrochemical nanoimprinting with solid-state superionic stamps. Nano Lett. 7, 446-451 (2007).

Jane, A. et al., "Porous silicon biosensors on the advance," Trends in Biotechnology (2009) 27(4):230-239.

Jiao, Y. et al., "Patterned nanoporous gold as an effective SERS template. Nanotechnology 22," 5302 (2011).

Kasuga, T. et al., "Formation of titanium oxide nanotube," Langmuir (1998) 14:3160-3163.

Kneipp, K. et al., "Single molecule detection using surface-enhanced Raman scattering (SERS)" Phys. Rev. Lett. (1997) 78(9):1667-1670.

Kucheyev, S.O. et al., "Surface-enhanced Raman scattering on nanoporous Au," Appl. Phys. Lett. (2006) 89:053102-1-053102-3.

Lang, X. Y. et al., "Localized surface plasmon resonance of nanoporous gold," Appl. Phys. Lett. 98, 093701 (2011).

Lang, X.Y. et al., "Geometric effect on surface enhanced Raman scattering of nanoporoud gold: improving Raman scattering by tailoring ligament and nanopore ratios," Appl. Phys. Lett. (2009) 94:213109-1-213109-3.

Larouche, S. et al., "Infrared metamaterial phase holograms," Nat. Mater. 11, 450-454 (2012).

Lawrie, J. L. et al., "Size-Dependent Infiltration and Optical Detection of Nucleic Acids in Nanoscale Pores," IEEE Trans. Nanotechnol. 9, 596-602 (2010).

Lee et al., "Fabrication of the Funnel-shaped Three-Dimensional Plasmonic Tip Arrays by Directional Photofluidization Lithography," (2010) ACS Nano 2, 2465-2472, 7175-7184.

Levy, U. et al., "Design, fabrication, and characterization of circular Dammann gratings based on grayscale lithography," Opt. Lett. 35, 880-882 (2010).

Li, A.P. et al., "Hexagonal pore arrays with a 50-420nm interpore distance formed by self-organization in anodic alumina," J. Appl. Phys. (1998) 84(11):6023-6026.

Liscidini, M. et al., "Gratings on porous silicon structures for sensing applications," in Conference on Lasers and Electro-Optics/International Quantum Electronics Conference, OSA Technical Digest (2008), paper CMG7, 2 pages.

Liscidini, M. et al., "Scattering-matrix analysis of periodically patterned multilayers with asymmetric unit cells and birefringement media," Physical Review B (2008) 77:035324, 11 pages.

Low, S. P., Williams, K. A., Canham, L. T. & Voelcker, N. H. Evaluation of mammalian cell adhesion on surface-modified porous silicon. Biomaterials 27, 4538-4546 (2006).

Moskovits, M. "Surface-enhanced spectroscopy," Rev. Mod. Phys. (1985) 57:783-826.

Park, J. H. et al., "Biodegradable luminescent porous silicon nanoparticles for in vivo applications," Nat. Mater. 8, 331-336 (2009).

PCT/US2011/001627 International Search Report dated Dec. 30, 2011 (3 pages).

Qian, L.H. et al., "Surface enhanced Raman scattering of nanoporous gold: smaller pore sizes stronger enhancements," Appl. Phys. Lett. (2007) 90:153120-1-153120-3.

Ruffato, G. et al., "Nanoporous gold plasmonic structures for sensing applications," Opt. Express 19, 13164-13170 (2011).

Ryckman, J. D. et al., "Direct Imprinting of Porous Substrates: A Rapid and Low-Cost Approach for Patterning Porous Nanomaterials," Nano Lett. 11, 1857-1862 (2011).

Ryckman, J.D. et al., "Low-cost optical microstructures fabricated by imprinting porous silicon," Advanced Fabrication Technologies for Micro-Nano Optics and Photonics III, edited by Winston V. Schoenfeld, Proc. of SPIE 7591 (2010) 759108-1 to 9.

Ryckman, J.D. et al., "Micron and submicron sized optical structures fabricated by imprinting porous silicon," Porous Semiconductors—Science and Technology Conference, Valencia, Spain, Mar. 2010, 2 pages.

Sardana, N. et al., "Propagating surface plasmons on nanoporous gold," J Opt Soc Am B 29, 1778-1783 (2012).

(56) References Cited

OTHER PUBLICATIONS

Schleunitz, A. et al., "Selective profile transformation of electron-beam exposed multilevel resist structures based on a molecular weight dependent thermal reflow," J Vac Sci Technol B 29, F302 (2011).
Sipe, J.E. et al., "Enhancement of diffraction-based biosensing using porous structures and electromagnetic surface states," Proc. of SPIE 7553, 7553OM (Feb. 2010) 7 pages.
Sirbuly, D. J. et al., "Patterned microstructures of porous silicon by dry-removal soft lithography". Adv Mater 15, 149 (2003).
Smith, R.L. et al., "Porous silicon formation mechanisms," J. Appl. Phys. (1992) 71:R1-R22.
Sondergaard, T. et al., "Plasmonic black gold by adiabatic nanofocusing and absorption of light in ultra-sharp convex grooves," Nat. Commun. 3 (2012).
Sun, W. et al., "Nano- to microscale porous silicon as a cell interface for bone-tissue engineering," Adv Mater 19, 921 (2007).
Tascotti, E. et al., "Mesoporous silicon particles as a multistage delivery system for imaging and therapeutic applications," Nat. Nanotechnol. 3, 151-157 (2008).
United States Patent Office Action for U.S. Appl. No. 12/790,905 dated Apr. 3, 2012 (9 pages).
United States Patent Office Action for U.S. Appl. No. 12/790,908 dated Mar. 15, 2013 (9 pages).
United States Patent Office Action for U.S. Appl. No. 12/790,908 dated Sep. 10, 2012 (6 pages).
United States Patent Office Action for U.S. Appl. No. 12/790,908 dated Sep. 29, 2013 (8 pages).
United States Patent Office Action for U.S. Appl. No. 13/825,152 dated Apr. 7, 2014 (18 pages).
United States Patent Office Notice of Allowance for U.S. Appl. No. 12/790,905 dated Sep. 17, 2012 (8 pages).
Urquhart, K. S. et al., "Computer-Generated Holograms Fabricated by Direct Write of Positive Electron-Beam Resist," Opt. Lett. 18, 308-310 (1993).
Valentine, J. et al., "An optical cloak made of dielectrics," Nat. Mater. 8, 568-571 (2009).
Waits, C., A. et al., "Investigation of gray-scale technology for large area 3D silicon MEMS structures," Journal of Micromechanics and Microengineering 13, 170-177 (2003).
Wei, X. et al. "Guided mode biosensor based on grating coupled porous silicon waveguide," Opt. Express 19, 11330-11339 (2011).
Wei, X. et al., "Grating couplers on porous silicon planar waveguides for sensing applications," J. Appl. Phys. 104, 3113 (2008).
Wokaun, "Surface enhanced electromagnetic processes," Solid State Phys. (1984) 38:223-294.
Xia, Y. N. et al., "Complex optical surfaces formed by replica molding against elastomeric masters," Science 273, 347-349 (1996).
Yang, J. C. et al., "Enhanced Optical Transmission Mediated by Localized Plasmons in Anisotropic, Three-Dimensional Nanohole Arrays," Nano Lett. 10, 3173-3178 (2010).
Yu, F. et al., "Simultaneous excitation of propagating and localized surface plasmon resonance in nanoporous gold membranes," Anal Chem 78, 7346-7350 (2006).
Yu, W. X. et al., "Fabrication of refractive microlens in hybrid SiO2/TiO2 sol-gel glass by electron beam lithography," Opt. Express 11, 899-903 (2003).
Zaumseil, J. et al., "Three-dimensional and multilayer nanostructures formed by nanotransfer printing," Nano Lett. 3, 1223-1227 (2003).
Zentgraf, T. et al., "Plasmonic Luneburg and Eaton lenses. Nat. Nanotechnol," 6, 151-155 (2011).
Zentgraf, T. et al., "An Optical Janus Device for Integrated Photonics," Adv Mater 22, 2561-2564 (2010).
Zeon Corporation, Zeonrex Electornic Chemicals, ZEP520A Technical Report, "High Resolution Positive Electron Beam Resist," Version 1.01 (Apr. 2003) 12 pages).
Zheludev, N. I. et al., "From metamaterials to metadevices" Nat Mater 11, 917-924 (2012).
United States Patent Office Action for U.S. Appl. No. 12/790,908 dated Jul. 8, 2014 (6 pages).
United States Patent Office Interview Summary for U.S. Appl. No. 13/825,152 dated Jun. 27, 2014 (3 pages).
United States Patent Office Final Rejection for U.S. Appl. No. 13/825,152 dated Nov. 13, 2014 (23 pages).
Dreier et al., "Gold Films with imprinted cavities," J. Phys. Chem. Lett., Published on web Nov. 25, 2009, pp. 260-264.
Lee et al., "Imprinting well-controlled nanopore in organosilicate fils," Adv. Mater, 2005.
United States Patent Office Action for U.S. Appl. No. 13/825,125 dated Mar. 26, 2015 (24 pages).
United States Patent Office Final Office Action for U.S. Appl. No. 13/825,152 dated Aug. 13, 2015 (25 pages).
"Platinum-plated nanoporous gold: An efficient, low Pt loading electro-catalyst for PEM fuel cells" to Zeis, Journal of Power Sources 165, (2007) 65-72.
Direct Imprinting of Porous Substrates: A Rapid and Low-Cost. Approach for Patterning Porous Nanomaterials, to Ryckman et al. Pubs. acs.org/Nanolett, pp. 1857-1862 (published on Sep. 17, 2010).
Ryckman, et al., Porous Silicon Structures for Low-Cost Diffraction-Based Biosensing, Applied Physics Letters 92, 171103 (2010).
Kumar et al., "Features of gold having micrometer to centimeter dimensions can be fored through a combination of stamping with an elastomeric stamp and an alkanethiol "ink" followed by chemical etching"; App. Phys. Lett 63 (14), 1993.
Heit et al., "A Benchtop Method for the Fabrication and Patterning of Nanoscale Structures on Polymers", J Am. Chem. Soc. 2004, 126, 628-634.
United States Patent Office Notice of Allowance for U.S. Appl. No. 13/825,152 dated Dec. 11, 2016 (10 pages).
Office Action from the US Patent and Trademark Office for U.S. Appl. No. 13/825,152 dated Apr. 4, 2016 (20 pages).
United States Patent Office Action for U.S. Appl. No. 12/790,908 dated May 7, 2015 (6 pages).

* cited by examiner a b

POROUS NANOMATERIALS HAVING THREE-DIMENSIONAL PATTERNING

CROSS-REFERENCE TO RELATED APPLICATIONS

This patent application claims priority to U.S. Provisional Patent Application No. 61/735,871, filed Dec. 11, 2012, and 61/849,111, filed Jan. 18, 2013, the disclosures of which are incorporated by reference herein in their entireties.

STATEMENT REGARDING FEDERALLY SPONSORED RESEARCH OR DEVELOPMENT

This invention was made with United States Government support under federal Grant No. W911NF-09-1-0101 awarded by the Army Research Office and with support of the Center for Nanophase Materials Sciences, which is sponsored at Oak Ridge National Laboratory by the Division of Scientific User Facilities. The United States Government has certain rights in this invention.

INTRODUCTION

Device fabrication can be carried out using traditional lithography and etching techniques, which are often expensive and limited by a trade-off between resolution and throughput. While nanoimprint lithography ("NIL") and soft lithography strategies may be promising pathways for eliminating this trade-off, such techniques require the use of an intermediate thermoplastic or resist material that must be applied and structured before the pattern can be transferred into the device material. This requires levels of processing complexity that add time and cost to device fabrication.

Three-dimensional (3D) patterning technologies enable complex micro- and nano-structures to be realized that are otherwise unachievable by conventional two-dimensional (2D) patterning routes. Gray-scale lithography (GSL) is one category of 3D patterning wherein both lateral and vertical dimensions can be precisely and arbitrarily tailored at the surface of a chip. Primary examples of GSL include gray-scale variants of electron-beam lithography (EBL), laser direct write and masked photolithography, and focused ion-beam milling. See, e.g., del Campo, A. & Arzt, E., "Fabrication approaches for generating complex micro- and nanopatterns on polymeric surfaces," (2008) Chem. Rev. 108, 911-945; Geissler, M. & Xia, Y., "Patterning: Principles and Some New Developments," (2004) Adv. Mater. 16, 1249-1269; and Guo et al., "Grayscale photomask fabricated by laser direct writing in metallic nano-films," (2009) Opt. Express 17, 19981-19987, each of which is incorporated herein in its entirety by reference. When applied to materials ranging from semiconductors, to metals and polymers, 3D patterning technologies enable applications in diffractive and micro-optics (see, e.g., Fu et al., "Diffractive optical elements with continuous relief fabricated by focused ion beam for monomode fiber coupling," (2000) Opt. Express 7, 141-147; Yu, W. X. & Yuan, X. C., "Fabrication of refractive microlens in hybrid SiO2/TiO2 sol-gel glass by electron beam lithography," (2003) Opt. Express 11, 899-903; and Levy et al., "Design, fabrication, and characterization of circular Dammann gratings based on grayscale lithography," (2010) Opt. Lett. 35, 880-882, each of which is incorporated herein in its entirety by reference), holography (see, e.g., Urquhart et al., "Computer-Generated Holograms Fabricated by Direct Write of Positive Electron-Beam Resist," (1993) Opt. Lett. 18, 308-3107, which is incorporated herein in its entirety by reference), plasmonics and transformation optics (see, e.g., Yang et al., "Enhances Optical Transmission Mediated by Localized Plasmons in Anisotropic Three-Dimensional Nanohole Arrays," (2010) Nano Lett. 10, 3173-3178; and Zentgraf et al., "Plasmonic Luneburg and Eaton Lenses," (2011) Nat. Nanotechnol. 6, 151-155, each of which is incorporated herein in its entirety by reference), and microelectro-mechanics (MEMS) (see, e.g., Waits et al., "Investigation of gray-scale technology for large area 3D silicon MEMS structures," (2003) Journal of Micromechanics and Microengineering 13, 170-177, which is incorporated herein in its entirety by reference). Compared to most bulk and thin-film solids, porous nanomaterials offer a large internal surface area and distinct optical, electrical, and mechanical properties that can be controlled over a wide range by adjusting the pore morphology (i.e. porosity, pore size, and shape). Extending GSL techniques to porous nanomaterials is an especially attractive, yet unexplored, combination that would enable their unique nanoscaled properties to be exploited in many of the aforementioned applications. In addition to the fabrication of 3D structures, the ability to arbitrarily manipulate the internal porous network and achieve tailored material properties across the surface of a chip, such as laterally tuning the nanoscaled morphology or effective optical properties, could open new possibilities for many existing applications of porous nanomaterials, for example in: biomaterials, label-free chemical or biological sensing, drug delivery and imaging, and surface enhanced Raman spectroscopy (SERS).

Direct imprinting of porous substrates (DIPS) was recently demonstrated as a rapid, low-cost, and high fidelity approach for patterning porous nanomaterials. See, e.g., Ryckman et al., "Direct Imprinting of Porous Substrates: A Rapid and Low-Cost Approach for Patterning Porous Nanomaterials," (2011) Nano Lett. 11, 1857-1862, U.S. Pat. No. 8,349,617, and U.S. Patent Application Pub. No. 2011/0056398, each of which is incorporated herein in its entirety by reference. DIPS overcomes many of the challenges and limitations faced when implementing conventional lithographic strategies on porous substrates. For example, challenges can arise from difficulty working with resists and developers, such as poor adhesion, infiltration deep into the pores, or irrevocable corroding or clogging of the porous network. Further, conventional lithographic strategies and etching techniques are expensive, both in terms of time and cost, and are limited by a trade-off between resolution and throughput. See, e.g., Sirbuly et al., "Patterned microstructures of porous silicon by dry-removal soft lithography," (2003) Adv. Mater. 15, 149, which is incorporated herein in its entirety by reference. By directly patterning porous nanomaterials through the use of a reusable pre-patterned stamp, DIPS eliminates the need for repeated application of masking materials, exposures, development, and etching chemistries.

To date, DIPS has only been demonstrated using binary patterns, where a 2D stamp pattern is transferred to the porous substrate at a uniform depth across the sample. However, there is no fundamental limitation in extending DIPS to 3D pattern replication by using a premastered 3D stamp. 3D imprinting and molding have been demonstrated in a variety of techniques on solid substrates including replica molding using elastomeric masters (see, e.g., Xia et al., "Complex optical surfaces formed by replica molding against elastomeric masters," (1996) Science 273, 347-349, which is incorporated herein in its entirety by reference), step-and-flash imprint lithography using multi-level patterned stamps (see, e.g., Gates et al., "New approaches to nanofabrication: Molding, printing, and other techniques," (2005) Chem. Rev. 105, 1171-1196; and Guo, L. J., "Nanoimprint Lithography: Methods and Material Requirements," (2007) Adv. Mater. 19, 495-513, each of which is incorporated herein in its entirety by reference), nanotransfer printing using conformal ink layers (Zaumseil et al., "Three-dimensional and multilayer nanostructures formed by nanotransfer printing," (2003) Nano Lett. 3, 1223-1227, which is incorporated herein in its entirety by reference), and electrochemical nanoimprinting using solid-state superionic stamps (see, e.g., Hsu et al., "Electrochemical nanoimprinting with solid-state superionic stamps," (2007) Nano Lett. 7, 446-451, which is incorporated herein in its entirety by reference).

Nanoporous gold (np-Au) is a unique, metallic porous nanomaterial, which can support both propagating and localized surface plasmonic effects. See, e.g., Lang et al., "Localized surface plasmon resonance of nanoporous gold," (2011) Appl. Phys. Lett. 98, 093701; Bok et al., "Multiple surface plasmon modes for a colloidal solution of nanoporous gold nanorods and their comparison to smooth gold nanorods," (2008) Nano Lett. 8, 2265-2270; Yu et al., "Simultaneous excitation of propagating and localized surface plasmon resonance in nanoporous gold membranes," (2006) Anal. Chem. 78, 7346-7350; and Sardana et al., "Propagating surface plasmons on nanoporous gold," (2012) J. Opt. Soc. Am. B 29, 1778-1783, each of which is incorporated herein in its entirety by reference. Each of these effects is particularly sensitive to the effective dielectric constant and pore dimensions, respectively. Controlling the pore dimensions and porosity of np-Au is typically achieved during fabrication by adjusting the dealloying parameters (see, e.g., Ding et al., "Nanoporous gold leaf: "Ancient technology"/advanced material," Adv. Mater. 16, 1897-1900, which is incorporated herein in its entirety by reference), or by post process annealing or electroplating steps (see, e.g., Qian et al., "Surface enhances Raman scattering of nanoporous gold: Smaller pore sizes stronger enhancements," (2007) Appl. Phys. Lett. 90, 153120; and Lang et al., "Geometric effect on surface enhanced Raman scattering of nanoporous gold: Improving Raman scattering by tailoring ligament and nanopore ratios," (2009) Appl. Phys. Lett. 94, 213109, each of which is incorporated herein in its entirety by reference). No previous method has demonstrated tunable and localized patterning of the pore size, porosity, or dielectric function in a planar metallic film.

SUMMARY

In one aspect, provided are methods of imprinting a porous material. The methods may comprise applying a first stamp to a porous material having an average pore size of less than about 100 μm. The first stamp may comprise at least a first portion having a first height, a second portion having a second height and a third portion having a third height. The first height, second height and third height may be different.

In another aspect, provided are methods of modifying a desired property of a porous material having an average pore size of less than about 100 μm. The methods may comprise identifying a desired value of a desired property for at least three locations of the porous material; fabricating a first stamp having at least three portions, each of the at least three portions having a different height such that upon application of the first stamp to the porous nanomaterial, the at least three portions modify the desired property to the desired values at the at least three locations; and applying the first stamp to the porous nanomaterial to modify the desired values of the desired property at the at least three locations.

In yet another aspect, provided are patterned porous materials comprising a three-dimensional surface at least a portion of which is non-linear. The porous materials may have an average pore size of less than about 100 μm, and at least a first depth, a second depth, and a third depth, wherein the first depth, second depth and third depth are different.

DETAILED DESCRIPTION

Figure 1:
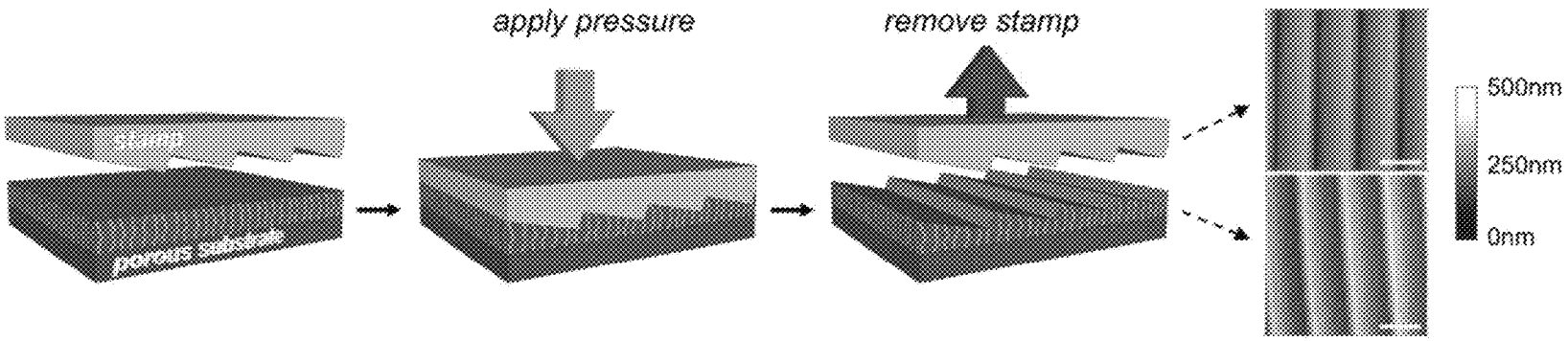
FIG. 1 is an illustration of gray-scale direct imprinting of porous substrates.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Other aspects of the disclosure will become apparent by consideration of the detailed description and accompanying drawings.

It is specifically understood that any numerical value recited herein (e.g., ranges) includes all values from the lower value to the upper value, i.e., all possible combinations of numerical values between the lowest value and the highest value enumerated are to be considered to be expressly stated in this application. For example, if a concentration range is stated as 1% to 50%, it is intended that values such as 2% to 40%, 10% to 30%, or 1% to 3%, etc., are expressly enumerated in this specification. These are only examples of what is specifically intended. With respect to amounts of components, all percentages are by weight, unless explicitly indicated otherwise.

The present application provides methods of patterning porous materials on the micro- and nanometer scale using a direct imprinting technique. The present methods of direct imprinting of porous substrates ("DIPS") can utilize reusable stamps that may be directly applied to an underlying porous material to selectively, mechanically deform and/or crush particular regions of the porous material, creating a desired structure. The process can be performed in a matter of seconds, at room temperature or higher temperatures, and may eliminate the requirement for intermediate masking materials and etching chemistries.

While the formation of porous materials is self-organizing and often remarkably straightforward, subsequent micro- and nanometer scale structuring of these materials is necessary for realizing devices with important applications, including drug delivery and imaging, chemical and biological sensing, and catalysis, and for the construction of novel biomaterials, battery anodes, and structures for use in plasmonics, integrated optoelectronics, and solar energy conversion.

As used herein, the term "porous material" refers to a material comprising pores.

As used herein, the term "porous nanomaterial" refers to a porous material where the relevant pore dimensions are on the order of or smaller than about 100 nm.

As used herein, the term "non-linear" refers to a shape that is not a straight line in two dimensions or not a flat plane in three dimensions.

Porous Materials

Porous materials, such as, for example, porous silicon ("pSi"), porous alumina ("pAl2O3"), nanoporous gold ("np-Au"), titanium dioxide nanotube arrays ("TiO2-NTAs"), and many others, are characterized by nanoscale voids and high specific surface area that give rise to desirable optical, electrical, chemical, and mechanical properties.

The average pore size may be less than about 100 μm, about 50 μm, about 10 μm, about 5 μm, about 1 μm, about 500 nm, about 100 nm, about 95 nm, about 90 nm, about 85 nm, about 80 nm, about 75 nm, about 70 nm, about 65 nm, about 60 nm, about 55 nm, about 50 nm, about 45 nm, about 40 nm, about 35 nm, about 30 nm, about 25 nm, about 20 nm, about 15 nm, about 10 nm, about 5 nm, about 4 nm, about 3 nm, about 2 nm, or less than about 1 nm. The pore size may be greater than about 1 nm, about 2 nm, about 3 nm, about 4 nm, about 5 nm, about 10 nm, about 15 nm, about 20 nm, about 25 nm, about 30 nm, about 35 nm, about 40 nm, about 45 nm, about 50 nm, about 55 nm, about 60 nm, about 65 nm, about 70 nm, about 75 nm, about 80 nm, about 85 nm, about 90 nm, about 95 nm, about 100 nm, about 500 nm, about 1 μm, about 5 μm, about 10 μm, about 50 μm, or greater than about 100 μm. Preferred average pore sizes may be between about 1 nm and about 10 μm, more preferably, about 2 nm and about 1 μm, or most preferably, about 5 nm and about 100 nm.

Porous materials that may be used in the structures described herein may include, but need not be limited to, porous silicon, porous gold, porous aluminum, porous copper, porous silver, porous germanium, porous tin, porous silicon dioxide, porous aluminum oxide, porous titanium dioxide, porous gallium phosphide, porous indium phosphide, porous gallium arsenide, porous gallium nitride, porous polymers, porous sol-gels, or a mixture thereof. The porous materials may be nanomaterials. As used herein, porosity of a material refers to the ratio of the volume of empty space over the volume of a unit structure. For example, in some embodiments, for a porous rectangle L×H×W, the porosity is the volume of empty space per the L×H×W volume. Because the porosity is a ratio, it is unitless. Porosity may be reported as a decimal number, a fraction, or a percentage.

The porosity of the porous materials used herein may be greater than about 10%, preferably greater than about 50%, more preferably greater than about 70%. The porosity may be greater than about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 59%, about 60%, about 61%, about 62%, about 63%, about 64%, about 65%, about 66%, about 67%, about 68%, about 69%, about 70%, about 71%, about 72%, about 73%, about 74%, about 75%, about 76%, about 77%, about 78%, about 79%, about 80%, about 81%, about 82%, about 83%, about 84%, about 85%, about 86%, about 87%, about 88%, about 89%, about 90%, about 91%, about 92%, about 93%, about 94%, or greater than about 95%. The porosity of the porous materials used herein may be preferably less than about 95%. The porosity may be less than about 95%, about 94%, about 93%, about 92%, about 91%, about 90%, about 89%, about 88%, about 87%, about 86%, about 85%, about 84%, about 83%, about 82%, about 81%, about 80%, about 79%, about 78%, about 77%, about 76%, about 75%, about 74%, about 73%, about 72%, about 71%, about 70%, about 69%, about 68%, about 67%, about 66%, about 65%, about 64%, about 63%, about 62%, about 61%, about 60%, about 59%, about 58%, about 57%, about 56%, about 55%, about 54%, about 53%, about 52%, about 51%, about 50%, about 49%, about 48%, about 47%, about 46%, about 45%, about 44%, about 43%, about 42%, about 41%, about 40%, about 39%, about 38%, about 37%, about 36%, about 35%, about 34%, about 33%, about 32%, about 30%, about 29%, about 28%, about 27%, about 26%, about 25%, about 24%, about 23%, about 22%, about 21%, about 20%, about 19%, about 18%, about 17%, about 16%, about 15%, about 14%, about 13%, about 12%, about 11%, or less than about 10%. Porosity of the porous material may be from about 10% to about 95%, and more preferably, about 20% to about 95%, more preferably about 40% to about 85%, and most preferably, about 60 to about 80%.

Porous materials offer a large internal surface area (about 100 $m^2/cm^3$) and highly tunable pore dimensions, making them particularly interesting for use in a variety of applications including photovoltaics, integrated optics, drug-delivery, and sensing of biological and chemical species. Precise control over pore morphology can be obtained by varying anodization parameters such as current density, voltage, electrolyte composition, substrate doping, and process temperature. See, e.g., Li et al., "Hexagonal pore arrays with a 50-420 nm interpore distance formed by self-organization in anodic alumina," (1998) J. Appl. Phys. 84, 6023-6026; Ding et al., "Nanoporous gold leaf: 'ancient technology'/advanced material," (2004) Adv. Mater. 16, 1897-1900; Kasuga et al., "Formation of titanium oxide nanotube," (1989) Langmuir 14, 3160-3163; and Smith et al., "Porous silicon formation mechanisms," (1992) J. Appl. Phys. 71, R1-R22, each of which is incorporated herein in its entirety by reference.

In porous silicon ("pSi") for example, pore diameters ranging from less than 2 nm to greater than 3 μm have been demonstrated. Moreover, as a porous material, composed of part air and part silicon (with or without additional constituents), porous silicon can potentially be crushed or compressed. For example, under ideal circumstances, a 50% porosity layer of porous silicon could be compressed to half of its initial thickness i.e., 50% compression, where contacted by a stamp. Alternatively, porous silicon may simply be crushed in selected regions and debris then washed away.

In some embodiments, the porous material may have a thickness of greater than about 5 nm, about 25 nm, about 50 nm, about 60 nm, about 70 nm, about 80 nm, about 90 nm, about 100 nm, about 125 nm, about 150 nm, about 175 nm, about 200 nm, about 250 nm, about 300 nm, about 350 nm, about 400 nm, about 450 nm, about 500 nm, about 550 nm, about 600 nm, about 650 nm, about 700 nm, about 750 nm, about 800 nm, about 850 nm, about 900 nm, about 950 nm, about 1 μm, about 2 μm, about 3 μm, about 4 μm, about 5 μm, about 6 μm, about 7 μm, about 8 μm, about 9 μm, about 10 μm, about 15 μm, about 20 μm, about 25 μm, or greater than about 50 μm. In some embodiments, the porous material may have a thickness of less than about 100 μm, about 75 μm, about 50 μm, about 40 μm, about 30 μm, about 20 μm, about 10 μm, about 9 μm, about 8 μm, about 7 μm, about 6 μm, about 5 μm, about 4 μm, about 3 μm, about 2 μm, about 1 μm, about 950 nm, about 900 nm, about 850 nm, about 800 nm, about 750 nm, about 700 nm, about 650 nm, about 600 nm, about 550 nm, about 500 nm, about 450 nm, about 400 nm, about 350 nm, about 300 nm, about 250 nm, about 225 nm, about 200 nm, about 175 nm, about 150 nm, about 125 nm, about 100 nm, about 90 nm, about 80 nm, about 70 nm, about 60 nm, about 50 nm, about 40 nm, about 30 nm, about 20, or less than about 10 nm. This includes preferred ranges of about 20 nm to about 20 μm, more preferably about 30 nm to about 2 μm, and most preferably, about 50 nm to about 1 μm.

In some embodiments, the porous material may have a desired property. The desired property may be selected from the group consisting of porosity, average pore size, dielectric constant, plasmonic response, index of refraction, conductivity, resistivity, and combinations thereof. In certain embodiments, the properties of the porous materials may be modified using the methods described herein.

Substrates

In some embodiments, a porous material may be prepared on a substrate support. The substrate may comprise, for example, at least one of silicon, glass, metal, quartz, plastic, polymers, or combinations thereof. In some embodiments, the substrate can be a solid substrate. In some embodiments, the substrate may preferably include solid silicon or solid glass.

Stamps

Stamps used in embodiments of the present application generally have a hardness greater than the hardness of the material being imprinted and can be pre-mastered i.e., they may have a patterned surface or surfaces. Pre-mastering of a stamp can be accomplished through conventional lithographic techniques, such as, for example, photolithography, reactive ion etching, electron beam lithography, wet etching, dry etching, focused ion-beam milling, laser machining, and combinations of these methods. In preferred embodiments, the stamp is fabricated by gray-scale lithography. In some embodiments, a pre-mastered stamp may be a reusable stamp. In some embodiments, a stamp material may comprise at least one of silicon, silicon dioxide, quartz, silicon nitride, silicon carbide, sapphire, tungsten, molybdenum, and combinations thereof. Other suitable materials include metals and polymeric materials. In some embodiments, the stamp may comprise a material with a material hardness of at least about 100 MPa, at least about 500 MPa, at least about 1 GPa, about 3 GPa, about 5 GPa, about 8 GPa, about 10 GPa, about 15 GPa, or at least about 20 GPa.

A stamp pattern can include any desired pattern, such as, for example, straight lines, curved lines, dots, circles, ovals, polygons, irregular shapes, periodic arrays of shapes, periodic arrays of images, periodic arrays of outlines, aperiodic arrays of shapes, aperiodic arrays of images, aperiodic arrays of outlines, etc. and combinations thereof.

In some embodiments, the stamp may comprise a plurality of portions having a plurality of heights having the same or different heights. For example, a stamp may have a first portion having a first height, a second portion having a second height and third portion having a third height, wherein the first height, second height and third height are different. In short, the stamp may comprise any number of portions having any number of different heights. The stamps may be used to impart three dimensional patterns in the surface of the porous materials.

In some embodiments, the stamp may comprise any desired height profile. In some embodiments, the stamp may comprise: (i) continuous height profiles (a continuous profile without curvature, such as a gradient or blazed structure, where the height profile continuously varies in a linear fashion between a minimum and maximum height); (ii) curvilinear height profiles (a continuous profile containing curvature, such as a dome or a cone, wherein the height profile continuously varies in a nonlinear fashion); (iii) discrete height profiles (digital patterns where at least three multiple discrete heights are contained); (iv) fine features with sharpness, both inward (pits, grooves, etc.) and outward (tips, edges, etc.); and combinations thereof.

Applied Pressures

The stamps may be applied at an appropriate pressure to the porous materials. In some embodiments, the applied pressure may be at least about 1 $N/mm^2$, about 5, about 10, about 15, about 20, about 25, about 30, about 35, about 40, about 45, about 50, about 55, about 60, about 65, about 70, about 75, about 80, about 85, about 90, about 95, about 100, about 125, about 150, about 175, about 200, about 225, about 250, about 250, about 275, about 300, about 325, about 350, about 375, about 400, about 425, about 450, about 475, about 500, about 750, and at least about 1000 $N/mm^2$. In some embodiments, the applied pressure may be at most about 10 $kN/mm^2$, at most about 1000, about 750, about 500, about 475, about 450, about 425, about 400, about 375, about 350, about 325, about 300, about 275, about 250, about 225, about 200, about 175, about 150, about 125, about 100, about 90, about 80, about 70, about 60, about 50, about 40, about 30, about 20, and at most about 10 $N/mm^2$. Applied pressures suitable for methods of the present application may commonly include pressures of about 1 $N/mm^2$ to about 10 $kN/mm^2$, particularly, about 50 $N/mm^2$ to about 500 $N/mm^2$, and more particularly, about 100 $N/mm^2$ to about 300 $N/mm^2$.

Temperatures

In some embodiments, the methods of the present application can be carried out at temperatures of at least about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., about 30° C., about 31° C., about 32° C., about 33° C., about 34° C., about 35° C., about 40° C., about 45° C., about 50° C., about 60° C., about 70° C., about 80° C., about 90° C., about 100° C., about 110° C., about 120° C., about 130° C., about 140° C., about 150° C., about 160° C., about 170° C., about 180° C., about 190° C., about 200° C., about 250° C., about 300° C., about 350° C., about 400° C., about 450° C., about 500° C., about 600° C., about 700° C., about 800° C., about 900° C., about 1000° C., or at least about 1100° C. In some embodiments, the methods of the present application can be carried out at temperatures of less than about 1200° C., about 1100° C., about 1000° C., about 900° C., about 800° C., about 700° C., about 600° C., about 500° C., about 450° C., about 400° C., about 350° C., about 300° C., about 250° C., about 200° C., about 190° C., about 180° C., about 170° C., about 160° C., about 150° C., about 140° C., about 130° C., about 120° C., about 110° C., about 100° C., about 95° C., about 90° C., about 85° C., about 80° C., about 75° C., about 70° C., about 65° C., about 60° C., about 55° C., about 50° C., about 49° C., about 48° C., about 47° C., about 46° C., about 45° C., about 44° C., about 43° C., about 42° C., about 41° C., about 40° C., about 39° C., about 38° C., about 37° C., about 36° C., about 35° C., about 34° C., about 33° C., about 32° C., about 31° C., about 30° C., about 29° C., about 28° C., about 27° C., about 26° C., about 25° C., about 24° C., about 23° C., about 22° C., about 21° C., about 20° C., about 19° C., about 18° C., about 17° C., or less than about 16° C. Methods of the present application can commonly be carried out at temperatures ranging from about 15° C. to about 1,200° C., particularly from about 20° C. to about 200° C., or more particularly from about 21° C. to about 27° C.

Imprinting

Compressing the stamps on the porous materials may create various depths in the porous materials. In some embodiments, the imprint depth in the porous material may be less than about 50%, about 49%, about 48%, about 47%, about 46%, about 45%, about 44%, about 43%, about 42%, about 41%, about 40%, about 39%, about 38%, about 37%, about 36%, about 35%, about 34%, about 33%, about 32%, about 30%, about 29%, about 28%, about 27%, about 26%, about 25%, about 24%, about 23%, about 22%, about 21%, about 20%, about 19%, about 18%, about 17%, about 16%, about 15%, about 14%, about 13%, about 12%, about 11%, about 10%, about 9%, about 8%, about 7%, about 6%, about 5%, about 4%, about 3%, about 2%, or less than about 1% of the height of the porous material at location that has not been imprinted. In some embodiments, the imprint depth can be greater than about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or greater than about 50% of the height of the porous material at location that has not been imprinted. The imprint depth may range from about 1% to about 95% of the height of the porous material that has not been imprinted, more preferably about 5% to about 95%, and most preferably about 10% to about 85% of the height of the porous material at location that has not been imprinted.

In general, the stamp may compress portions of the porous material by an amount up to about the porosity of the film (e.g., up to about 80% compression for an 80% porosity pSi, up to about 50% compression for a 50% porosity np-Au, etc.). In certain materials, such as np-Au, additional compression is possible, but will account for only a few percent of the total compression. In some embodiments, the stamp compresses portions of the porous material by at least about 3%, at least about 5%, at least about 8%, at least about 10%, at least about 13%, at least about 15%, at least about 18%, at least about 20%, at least about 25%, at least about 30%, at least about 35%, at least about 40%, at least about 45%, at least about 50%, at least about 55%, at least about 60%, at least about 65%, at least about 70%, at least about 75%, or at least about 80% relative to the porous material that has not been compressed. The stamp may also compress portions of the porous material by less than about 95%, less than about 90%, less than about 85%, less than about 80%, less than about 75%, less than about 70%, less than about 65%, less than about 60%, less than about 55%, less than about 50%, less than about 45%, less than about 40%, less than about 35%, less than about 30%, less than about 25%, less than about 20%, less than about 17%, less than about 15%, less than about 13%, less than about 10%, less than about 8%, less than about 5%, less than about 3%, less than about 2%, and less than about 1% relative to the porous material that has not been compressed. This includes a preferred range of about 1% to about 95%, a more preferred range of about 5% to about 95%, and a most preferred range of about 10% to about 85%.

In some embodiments, the stamp contacts the porous material for at least about 0.001 seconds, at least about 0.01 seconds, at least about 0.1, at least about 1, at least about 2, at least about 3, at least about 4, at least about 5, at least about 6, at least about 7, at least about 8, at least about 9, at least about 10, at least about 20, at least about 30, at least about 40, at least about 50, or at least about 60 seconds. In some embodiments, the stamp contacts the porous material for less than about 60 seconds, less than about 50, less than about 40, less than about 30, less than about 20, less than about 19, less than about 18, less than about 17, less than about 16, less than about 15, less than about 14, less than about 13, less than about 12, less than about 11, less than about 10, less than about 9, less than about 8, less than about 7, less than about 6, less than about 5, less than about 4, less than about 3, or less than about 2 seconds. This includes a preferred range of about 0.1 to about 30 seconds, a more preferred range of about 0.25 to about 10 seconds, and a most preferred range of about 0.5 to about 5 seconds.

Patterned Porous Nanomaterials

The methods of the present application produce patterned porous materials including patterned porous nanomaterials (e.g., by stamping). The patterned porous materials may include a variety of patterns on the surface. For example, the patterns may include straight lines, curved lines, dots, circles, ovals, polygons, irregular shapes periodic or aperiodic arrays of shapes, images, outlines, and combinations thereof. In some embodiments, the patterns may comprise any desired depth profile. In some embodiments, the pattern may comprise: (i) a continuous profile (such as a gradient or blazed structure, where the depth profile continuously varies between a minimum and maximum depth); (ii) curvilinear shapes (a continuous profile containing curvature); (iii) digital patterns where at least three multiple discrete heights are contained, and (iv) fine features with sharpness, both inward (pits, grooves, etc.) and outward (tips, edges, etc.).

In some embodiments, the patterned porous material may comprise a three-dimensional surface at least a portion of which is non-linear, the porous material having a first depth, a second depth, and a third depth, wherein the first depth, second depth and third depth are different. In other embodiments, the patterned porous material may have a first porosity at the first depth, a second porosity at the second depth, and a third porosity at the third depth, wherein the first porosity, second porosity and third porosity are different. The first porosity, second porosity and third porosity of the patterned porous material may be a function of the initial porosity of the porous material and the first depth, second depth and third depth, respectively.

In some embodiments, patterned porous material may have a plurality of depths (e.g., a first depth, second depth, third depth etc.) that may independently be greater than about 5 nm, about 25 nm, about 50 nm, about 60 nm, about 70 nm, about 80 nm, about 90 nm, about 100 nm, about 125 nm, about 150 nm, about 175 nm, about 200 nm, about 250 nm, about 300 nm, about 350 nm, about 400 nm, about 450 nm, about 500 nm, about 550 nm, about 600 nm, about 650 nm, about 700 nm, about 750 nm, about 800 nm, about 850 nm, about 900 nm, about 950 nm, about 1 μm, about 2 μm, about 3 μm, about 4 μm, about 5 μm, about 6 μm, about 7 μm, about 8 μm, about 9 μm, about 10 μm, about 15 μm, about 20 μm, about 25 μm, or greater than about 50 μm. In some embodiments, the plurality of depths may independently be less than about 100 μm, about 75 μm, about 50 μm, about 40 μm, about 30 μm, about 20 μm, about 10 μm, about 9 μm μm, about 8 μm, about 7 μm, about 6 μm, about 5 μm, about 4 μm, about 3 μm, about 2 μm, about 1 μm, about 950 nm, about 900 nm, about 850 nm, about 800 nm, about 750 nm, about 700 nm, about 650 nm, about 600 nm, about 550 nm, about 500 nm, about 450 nm, about 400 nm, about 350 nm, about 300 nm, about 250 nm, about 225 nm, about 200 nm, about 175 nm, about 150 nm, about 125 nm, about 100 nm, about 90 nm, about 80 nm, about 70 nm, about 60 nm, about 50 nm, about 40 nm, about 30 nm, about 20, or less than about 10 nm. This includes a preferred range of about 5 nm to about 30 μm, a more preferred range of about 10 nm to about 2 μm, and a most preferred range of about 10 nm to about 1 μm.

In some embodiments, the patterned porous nanomaterials may have a plurality of porosities (e.g., a first porosity, second porosity, third porosity, etc.) that may be the same or different and selected from the porosities delineated above.

In some embodiments, the patterned porous nanomaterials may comprise microparticles with arbitrary shape and size defined by the structure of the stamp. The microparticles are removed from the underlying substrate in the stamping process or are weakly attached to the underlying substrate and subsequently removed by a process known to those skilled in the art, such as using an adhesive, an electrochemical lift-off step, or by brief sonication in a liquid.

Uses

Potential device applications for porous materials patterned as described in the present application span areas including photovoltaics, batteries, drug delivery, chemical and biological sensing, and optoelectronics. Preferred uses include drug delivery and biological sensing.

EXAMPLES

Exemplary embodiments of the present invention are provided in the following examples. The following examples are presented to illustrate the present invention and to assist one of ordinary skill in making and using the same. The examples are not intended in any way to otherwise limit the scope of the invention.

Porous Substrates pSi films were prepared by electrochemically etching p-type Si(100) wafers (0.01-0.02 Ωcm) in a 3:7 (v/v) mixture of 49% hydrofluoric acid (HF) and ethanol. Etching was performed at a current density of 80 mA $cm^{-2}$ with the time adjusted to control the film thickness. Reflectance measurements and optical modeling were used to approximate the initial pSi porosity at ~80%. The underlying ~475-550 μm thick Si wafer supported the pSi films. np-Au films were prepared by a method described in a previous work. See, e.g., Ciesielski, P. N. et al. "Functionalized Nanoporous Gold Leaf Electrode Films for the Immobilization of Photosystem I," (2008) ACS Nano 2, 2465-2472, which is incorporated herein in its entirety by reference. Briefly, ~1.5×1.5 cm sheets of ~120-160 nm thick Monarch 12 karat white gold (fineartstore.com) were dealloyed by floating on concentrated nitric acid for 15 min. np-Au films were mounted on ~475-550 μm thick Si wafers coated with a >100 nm layer of Au, which was surface modified with 1,6-hexanedithiol for robust anchoring.

Stamps and Imprinting

Silicon stamps were prepared from ~475-550 μm thick Si(100) wafers by gray-scale EBL followed by anisotropic RIE, unless otherwise noted. Two different PMMA resists, 950k A4 (spun at 6,000 rpm and baked at 180° C. for 10 min) and 50k A20 (spun at 2,000 rpm and baked at 180° C. for 5 min) were employed to realize either shallow (~200 nm) or deep (~1.5 μm) structures, respectively. Gray-scale EBL (JEOL JBX-9300-100 kV) is performed with a 2 nA beam current, pattern shot pitch of 5 nm, and a base dose of 375 μC $cm^{-2}$, with the relative dose modulated from −33% to 0%. Development was performed in a 1:2 (v/v) mixture of de-ionized water and isopropyl alcohol for 30 s, followed immediately by drying under nitrogen. Thermal reflow of the resist was performed in some cases to smooth the resist profile and remove roughness by baking at 115° C. for 10 min to 1 hr, with intermittent evaluation under dark-field optical microscopy. See, e.g., Schleunitz, A., et al., "Selective profile transformation of electron-beam exposed multilevel resist structures based on a molecular weight dependent thermal reflow," (2011) J. Vac. Sci. Technol. B 29, F302, which is incorporated herein in its entirety by reference. Anisotropic reactive-ion etching was then performed (Oxford PlasmaLab 100) using $C_4F_8/SF_6/Ar$ process gases to transfer the resist pattern into the Si substrate. For sharply pointed stamps, conventional EBL and isotropic etching in $SF_6$ were employed. The duration of the isotropic etch is tuned to achieve sharp features at the intersection of neighboring etch fronts. Imprinting was performed in accordance to prior work. See, e.g., Ryckman et al., (2011). Briefly, a Tinius Olsen Super L 60k universal testing machine was used to press a flat metallic plate onto the backside of the stamp, which is covered with single-sided Scotch tape. A computer-monitored force was then delivered and sustained for less than 1 s.

The gradient patterned np-Au sample was immersed in 10 mM benzenethiol in ethanol for 1 hour to attach a monolayer of benzenethiol to the internal gold surface. The sample was then rinsed thoroughly with ethanol and dried under nitrogen flow. SERS measurements were performed using a DXR Raman microscope (Thermo Scientific) with a 780 nm diode laser at 0.9 mW power. A 10× objective (N=0.25) was employed, resulting in a ~3.1 μm spot size. Raman spectra were collected in a line-scanning mode with a 5 μm step-size, 1 s integration time and averaging of 2 scans.

Example 1

Gray-Scale DIPS

To demonstrate the basic function of gray-scale DIPS, a ~200 nm high, 10 μm period blazed grating silicon stamp was imprinted into a ~500 nm thick, high-porosity pSi thin film with a pressure of ~220 N/mm$^2$. Atomic force microscopy (AFM) images, shown in FIG. 1, reveal the high fidelity 1:1 pattern transfer of the gray-scale pattern that resulted in a ~200 nm height blazed pSi diffraction grating. The realization of such a grating is technologically important for enhancing diffraction efficiency, and could be implemented to improve coupling efficiency in grating-coupled pSi waveguide biosensors or improve the diffraction efficiency in porous diffraction based biosensors. See, e.g., Ryckman et al., "Porous silicon structures for low-cost diffraction-based biosensing," (2010) Appl. Phys. Lett. 96, 1103; and Wei, X. & Weiss, S. M., "Guided mode biosensor based on grating coupled porous silicon waveguide," (2011) Opt. Express 19, 11330-11339, each of which is incorporated herein in its entirety by reference. More advanced grating designs could enable porous nanomaterials to be cheaply implemented in a variety of diffractive optics applications, spanning from diffractive-lenses to holography, while offering a wider range of refractive indices compared to most plastics/polymers. See, e.g., Levy et al. (2010); Urquhart et al. (1993); and Xia et al. (1996).

Example 2

Gradient Profiles and Morphologies

Figure 2:
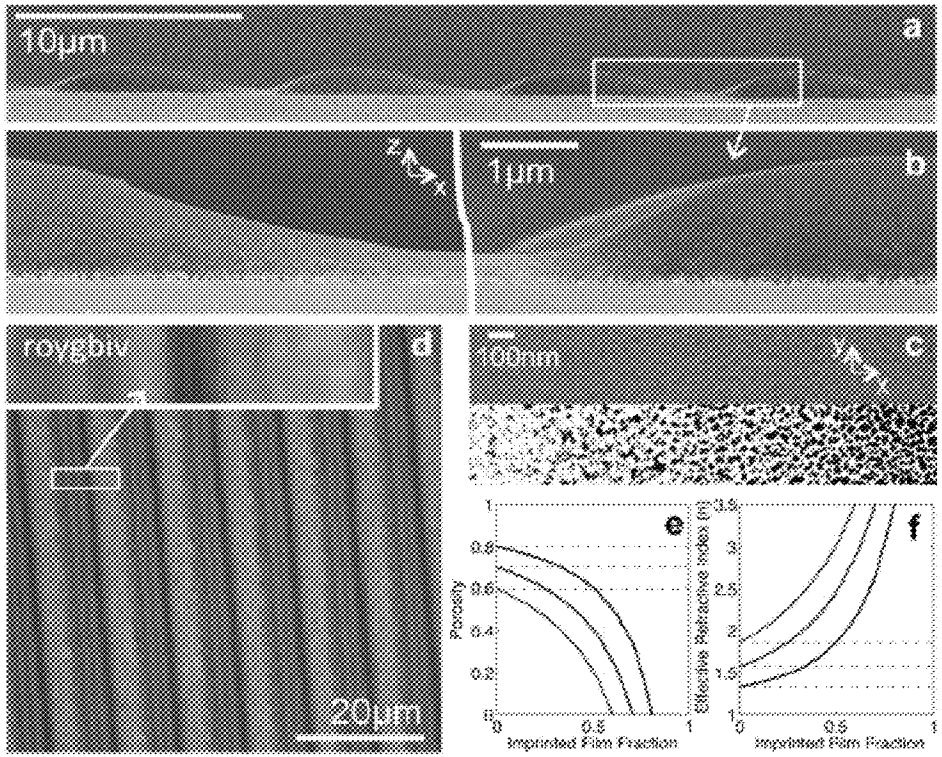
FIG. 2*a* is a cross-sectional scanning electron microscopy (SEM) image of a gray-scale patterned porous silicon (pSi) film with a microscale height profile prepared according to Example 2.
FIG. 2*b* is a cross-sectional SEM image of a gray-scale patterned pSi film with a microscale height profile prepared according to Example 2.
FIG. 2*c* is a top down SEM image and binary image revealing the gradient pore openings of a gray-scale patterned pSi film with a microscale height profile prepared according to Example 2.
FIG. 2*d* is a top-down optical microscope image of the film of FIGS. 2*a* to 2*c*.
FIG. 2*e* is a calculated variation in porosity and FIG. 2*f* is a calculated variation in refractive index for pSi thin films as a function of imprinted film fraction.
Figure 5:
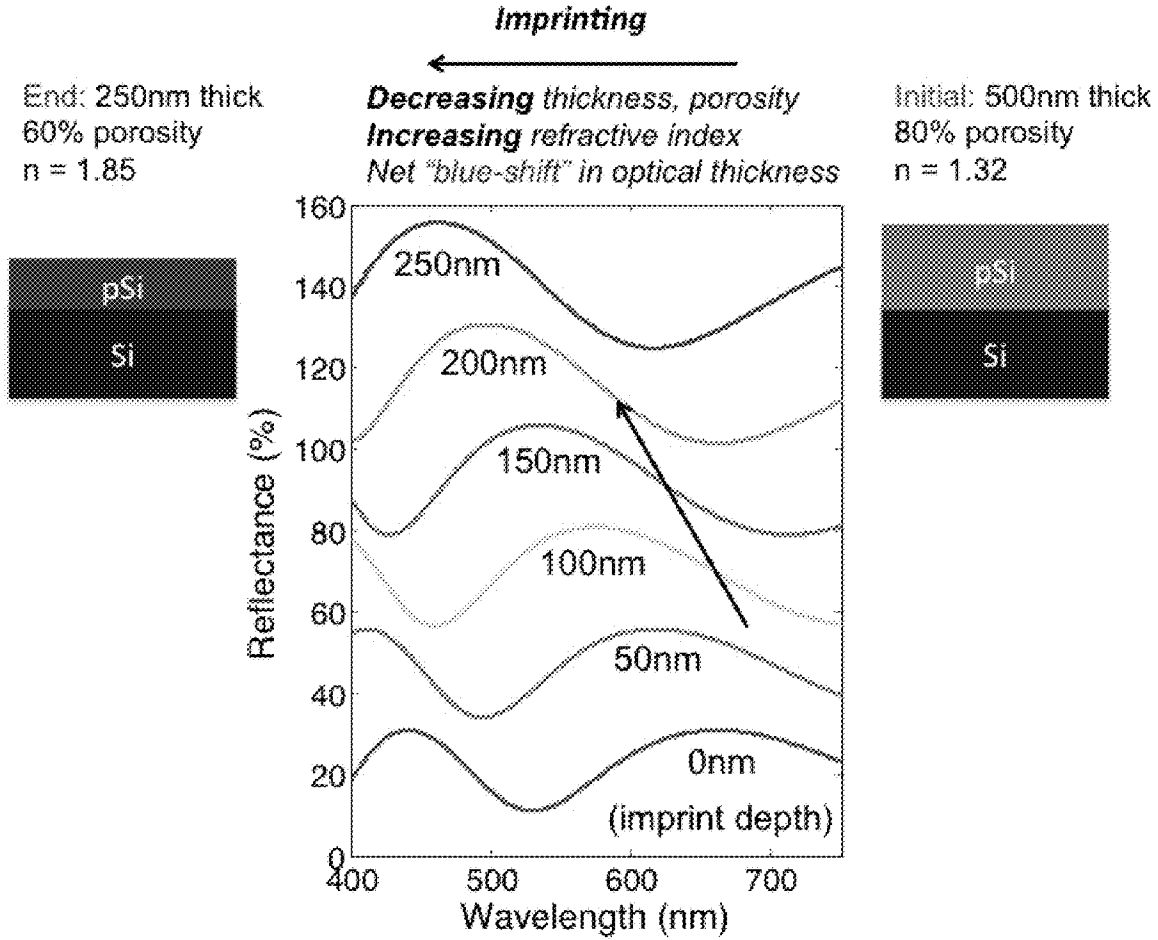
FIG. 5 shows the calculated variation in visible reflectance for pSi thin films as a function of imprint depth.

FIG. 2 shows scanning electron microscope (SEM) and optical microscope images of a ~2 μm thick high porosity pSi film after applying gray-scale DIPS with a ~1.5 μm height contoured silicon grating stamp. By imprinting deep gradient features into a pSi film of microscale thickness, a wide range of tailored properties can simultaneously be patterned and readily examined through standard SEM and optical imaging techniques. Cross-sectional SEM (FIGS. 2*a* and 2*b*) reveals a smoothly varying microscale height profile in the patterned pSi layer. Notably, the gray-scale profile is achieved by imparting a gray-scale densification to the porous layer. SEM reveals that the interior nano-structured porous matrix is continuously restructured, resulting in a gradient of porosities ranging from the initial '"80% high porosity to a very low, nearly 0%, porosity. Throughout most of the pattern, the local nanostructure and porosity appear to be very uniform within vertical slices (z-direction) of the pSi layer. Some buckling of the pores occurs along the lowest portion of the thicker regions in the patterned film, similar to the over-stamping effect noted in earlier work. See, e.g., Ryckman, et al. (2011). This effect can be enhanced or removed by changing the stamp height relative to the porous layer thickness, or by changing the applied pressure to adjust the imprinted film fraction. Examining this structure with top view SEM (FIG. 2*c*) reveals a gradient in the average pore opening size, ranging from approximately 30 nm to <5 nm, which coincides with the gradient in height and porosity observed from cross-sectional imaging. Optical microscopy (FIG. 2*d*) reveals that this gray-scale patterned pSi film exhibits strong variations in white light reflectivity. The observed color gradients, which span the entire visible spectrum, result from the strongly modulated optical thickness (product of index and thickness, nL) directly affecting the Fabry-Perot interference of the single layer thin-film. FIGS. 2*e* and 2*f* show calculations that provide a guide illustrating how adjusting the imprint depth tunes film porosity and effective refractive index. These calculations assume uniform densification, achieved solely through a reduction of the void fraction, and an isotropic refractive index determined from a Bruggeman effective medium approximation. Based on these primary assumptions, the maximum imprintable film fraction is therefore equal to the initial porosity. Gray-scale imprinting on a high porosity, low refractive index pSi film would thus enable a wide range of refractive indices, from ~1.3 to 3.5, to be realized with almost any arbitrarily designed lateral index gradient. Transfer-matrix calculations (see, FIG. 5) confirm a dramatic blue-shifting color change occurs in response to imprinting.

Example 3

Morphological Control Over Dielectric Constant and Plasmonic Response

Figure 3:
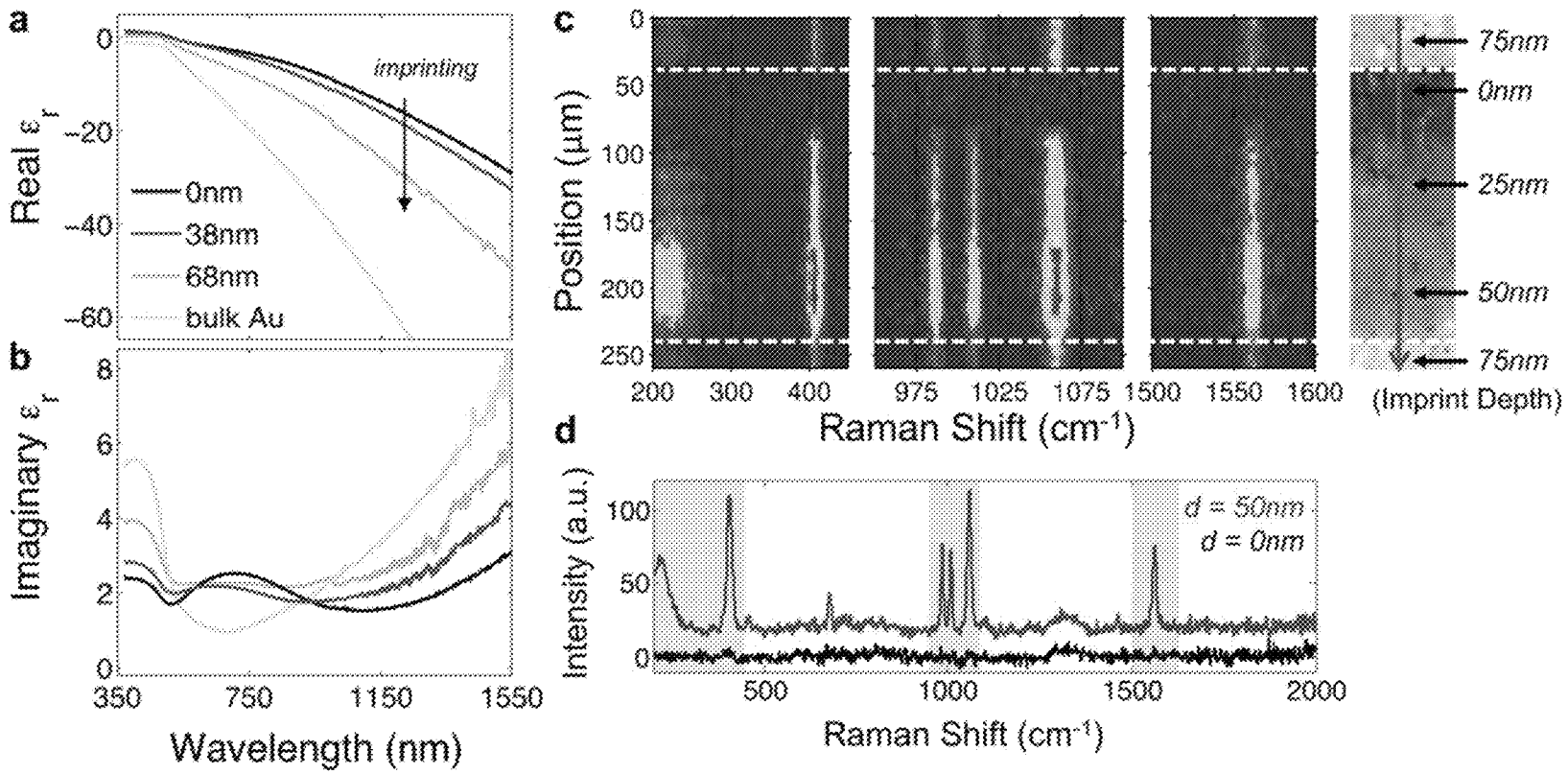
FIG. 3*a* is the real part and FIG. 3*b* is the imaginary part of the dielectric constant of np-Au, initially ~120 nm thick, imprinted at different depths.
FIG. 3*c* is a line-scanned SERS mapping of benzenethiol on gradient densified np-Au. The right-most frame is an optical microscope image of the measured sample.
FIG. 3*d* is a full SERS spectrum for benzenethiol on np-Au at selected imprint depths, d=0 nm and 50 nm.

FIGS. 3*a* and 3*b* reveal the complex dielectric function of np-Au, as determined by ellipsometry, after uniformly imprinting np-Au films to depths ranging from 0-68 nm. Compared to bulk gold, as prepared np-Au features a less negative real part of the dielectric constant, owing to its heterogeneous composition and reduced "metallic-like" character. After imprinting, however, the porosity is reduced and the real part of the dielectric constant is significantly decreased, i.e., from $Re(\epsilon_r)=-4.15$ to $Re(\epsilon_r)=-9.72$ at $\lambda=800$ nm. Imprinting similarly tunes the imaginary part of the dielectric constant, $Im(\epsilon_r)$, to approach that found for bulk Au. Consistent with other reports for as prepared np-Au, $Im(\epsilon_r)$ is generally 2-3 times smaller than for bulk Au in the ultra-violet and near-infrared regions, while $Im(\epsilon_r)$ is up to twice as large compared to bulk Au at visible wavelengths. See, e.g., Sardana et al. (2012). The observed changes in dielectric constant do not follow a direct linear relationship with imprint depth. Instead, the dielectric constant is increasingly modified at deeper imprint depths, which is expected given that porosity is also increasingly modified as shown in FIG. 2*e*. These results confirm that gray-scale DIPS can be used to arbitrarily tune porosity and dielectric constant over a wide range by simply adjusting the imprint depth. This new capability for locally tuning the dielectric constant could be used, for example, to locally control the dispersion of propagating plasmons on np-Au and enable the straightforward fabrication of plasmonic meta-devices. See, e.g., Sardana et al. (2012) and Zheludev et al., "From metamaterials to metadevices," (2012) Nat. Mater. 11, 917-924, which is incorporated herein in its entirety by reference.

In addition to tailoring the effective dielectric constant, gray-scale tuning of the pore size of np-Au also directly affects the activation of localized surface plasmons (LSP) arising from the nanoscaled morphology of np-Au. See, e.g., Lang et al. (2009); and Bosman et al., "Light Splitting in Nanoporous Gold and Silver," (2012) ACS Nano 6, 319-326. To demonstrate this capability, gray-scale DIPS was used to pattern a 200 μm long gradient height profile in np-Au, and used SERS to probe for localized electric field enhancements arising from LSP (FIG. 3*c*). Because gold itself is not Raman active, a monolayer of benzenethiol, which has a well-known Raman spectrum and is commonly used as a test molecule for SERS substrates, was attached. See, e.g., Jiao et al., "Patterned nanoporous gold as an effective SERS template," (2011) Nanotechnology 22, 5302, which is incorporated herein in its entirety by reference. Profilometry was performed to estimate a maximum imprint depth of ~75 nm. The gradient densification is readily observed by optical microscopy in the form of a strong color gradient from dark to light (FIG. 3*c*). SERS spectra were recorded in a linescan mapping (red arrow) along the entire 200 μm gradient pattern. The non-imprinted region of the pattern (d=0 nm), where the pore size is the largest, shows no detectable SERS signal (FIG. 3*d*). As np-Au is densified however, a clear enhancement of the SERS signal is observed for all the spectral bands of benzenethiol up to an imprint depth, d=~50 nm. The broadband SERS enhancement is indicative of the broadband localized plasmon resonance in np-Au (see, e.g., Bosman et al. (2012)), and the observed SERS enhancement is attributed to LSP activation and an increasing localized field enhancement with reducing pore size (see, e.g., Qian et al. (2007); Lang et al. (2009); and Bosman et al. (2012)). From prior work, the maximum SERS enhancement factor is conservatively estimated to be at least 106 and at least one order of magnitude greater than as-prepared np-Au. See, e.g., Jiao et al. (2011). Beyond ~50 nm imprint depth, the SERS signal is slightly reduced, although it remains detectable. The reduction in SERS enhancement beyond ~50 nm imprint depth, is likely due to the average pore size reducing to the point where many of the pores have become closed. If it were possible to continue imprinting until all of the pores were closed, the SERS signal would be expected to disappear entirely, resembling planar Au films. This particular experiment demonstrates that gray-scale DIPS enables not only the patterning of pore size, but also the tailoring of a material's plasmonic response and resulting SERS enhancement.

Example 4

Digital Patterns

Figure 4:
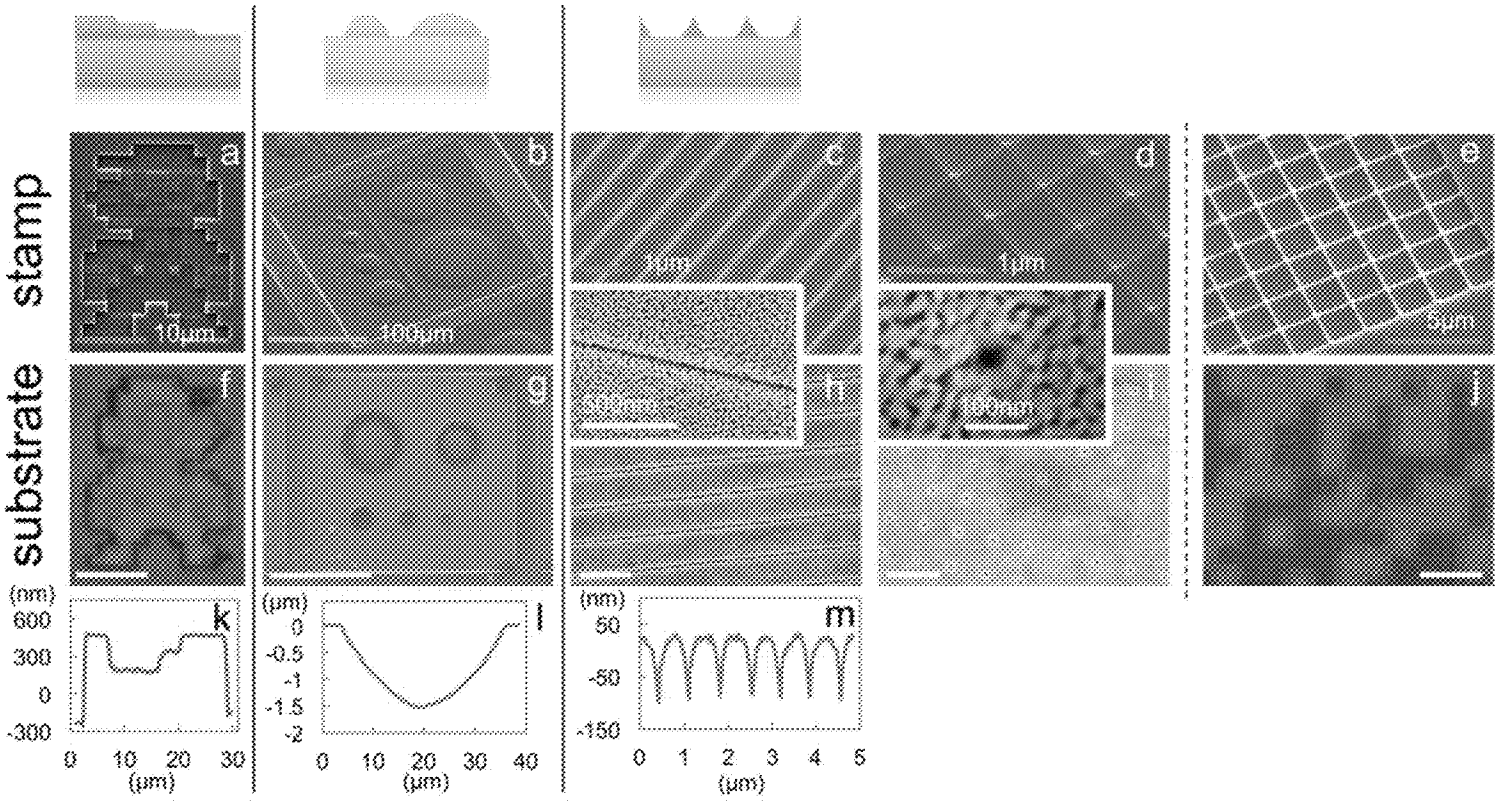
FIG. 4*a* is an SEM image of a silicon stamp used to pattern a porous nanomaterial.
FIG. 4*b* is an SEM image of a silicon stamp used to pattern a porous nanomaterial.
FIG. 4*c* is an SEM image of a silicon stamp used to pattern a porous nanomaterial.
FIG. 4*d* is an SEM image of a silicon stamp used to pattern a porous nanomaterial.
FIG. 4*e* is an SEM image of a silicon stamp used to pattern a porous nanomaterial.
FIG. 4*f* is an optical microscope image of patterned pSi formed by the stamp shown in FIG. 4*a*.
FIG. 4*g* is an optical microscope image of patterned pSi formed by the stamp shown in FIG. 4*b*.
FIG. 4*h* is an SEM image of patterned np-Au formed by the stamp shown in FIG. 4*c*.
FIG. 4*i* is an SEM image of patterned pSi formed by the stamp shown in FIG. 4*d*.
FIG. 4*j* is an SEM image of monodisperse 'cookie-cutter' pSi microparticles (dimensions 2×2×0.5 μm), formed by the stamp shown in FIG. 4*e*.
FIG. 4*k* is an AFM line scan of the patterned pSi of FIG. 4*f*.
FIG. 4*l* is an AFM line scan of the patterned pSi of FIG. 4*g*.
FIG. 4*m* is an AFM line scan of the patterned np-Au of FIG. 4*h*.
Figure 6:
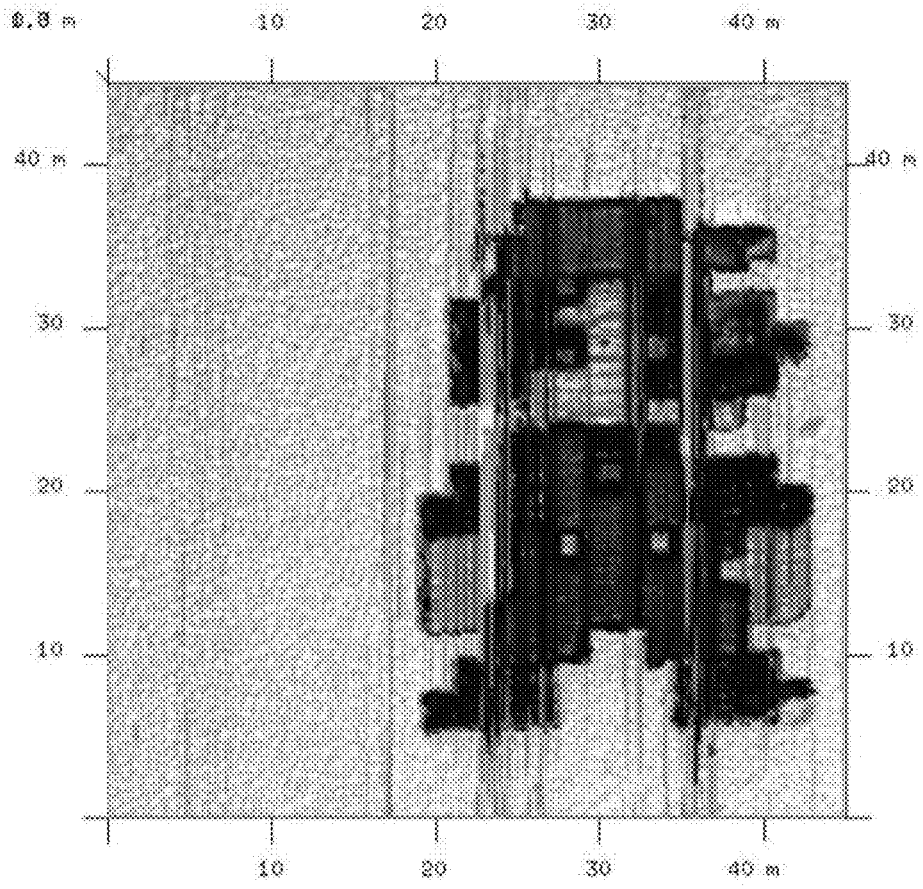
FIG. 6*a* is a full AFM map of the patterned pSi of FIG. 4*f*.
FIG. 6*b* is a full AFM map of the patterned pSi of FIG. 4*g*.
FIG. 6*c* is a full AFM map of the patterned np-Au of FIG. 4*h*.
Figure 6:
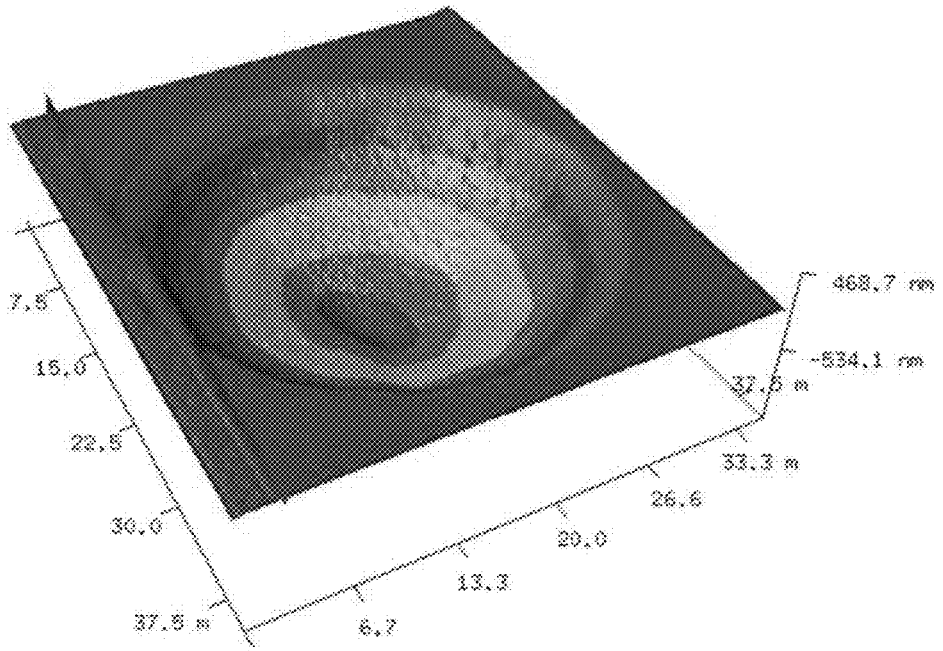
Figure 6:
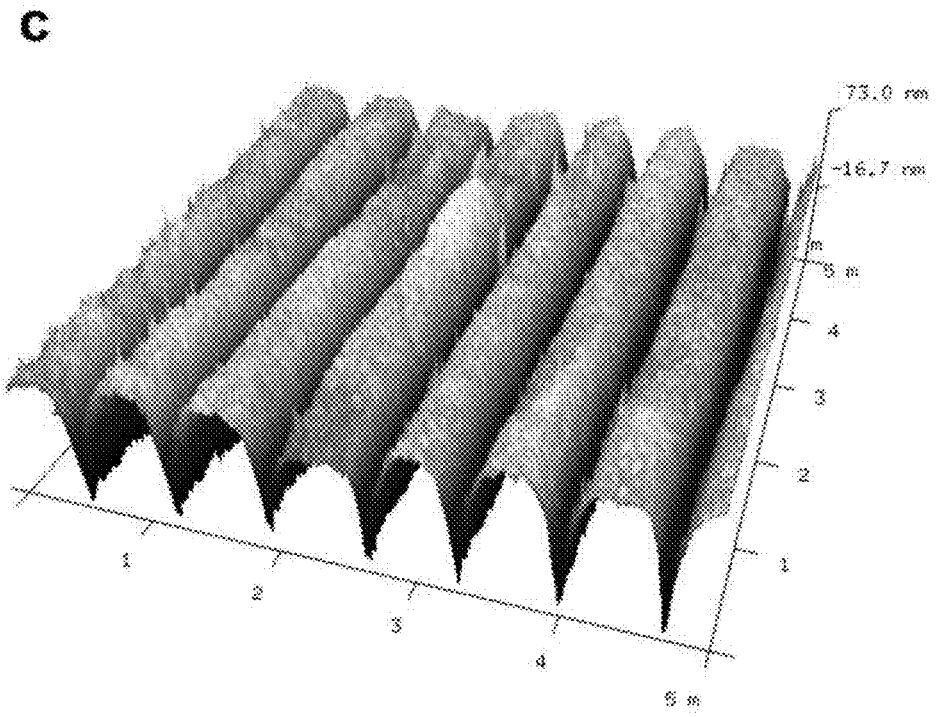

FIG. 4 shows porous nanomaterials patterned using gray-scale DIPS with three additional types of stamp patterns: {1) digital structures, {2) curvilinear dome shapes, and {3) sharp edges and tips. Digital patterns are formed by creating a stamp with multiple discrete height values, such as the Mario test pattern shown in FIG. 4*a*. This particular pattern is encoded with four different height values, representative of the different colors contained in the Mario source image. Imprinting into a ~1.5 μm pSi film enables direct digital patterning of the pSi substrate. Optical microscopy, under white-light illumination (FIG. 4*f*), reveals a multi-colored image that results from digitizing both the height and refractive index of the pSi layer. A cross-sectional AFM scan (FIG. 4*k*), taken vertically across the center of the pattern, confirms high-fidelity patterning of four discrete height values in the porous substrate. FIG. 6*a* shows a full AFM mapping of this structure. Based on this height profile, calculations (FIG. 2*f*) indicate that the porosity and refractive indices have been digitized to values: ~80%, 78%, 75%, 62% and ~1.32, 1.37, 1.43, 1.78, respectively. This example suggests that gray-scale DIPS could be used to realize a wide variety of digital patterns in porous nanomaterials, which is especially attractive for holographic applications where arbitrary refractive index tailoring is required to increase the number of phase levels that can simultaneously be achieved. Recent hologram designs utilize lithographic approaches to artificially tailor the refractive index through either an effective medium (see, e.g., Freese et al., "Design of binary subwavelength multiphase level computer generated holograms," (2010) Opt. Lett. 35, 676-678, which is incorporated herein in its entirety by reference), or metamaterial approach (see, e.g., Larouche et al., "Infrared metamaterial phase holograms," (2012) Nat. Mater. 11, 450-454, which is incorporated herein in its entirety by reference), but are limited in the number of achievable values or the operational wavelength range, respectively, by the patterning resolution. Gray-scale imprinting of porous nanomaterials, on the other hand, provides a route toward locally controlling the effective refractive index solely by the imprint depth. This promotes a broad range of accessible refractive indices while not being limited in the number of achievable index values by the lateral patterning resolution.

Example 5

Curvilinear Elements and Lens Shapes

Figure 7:
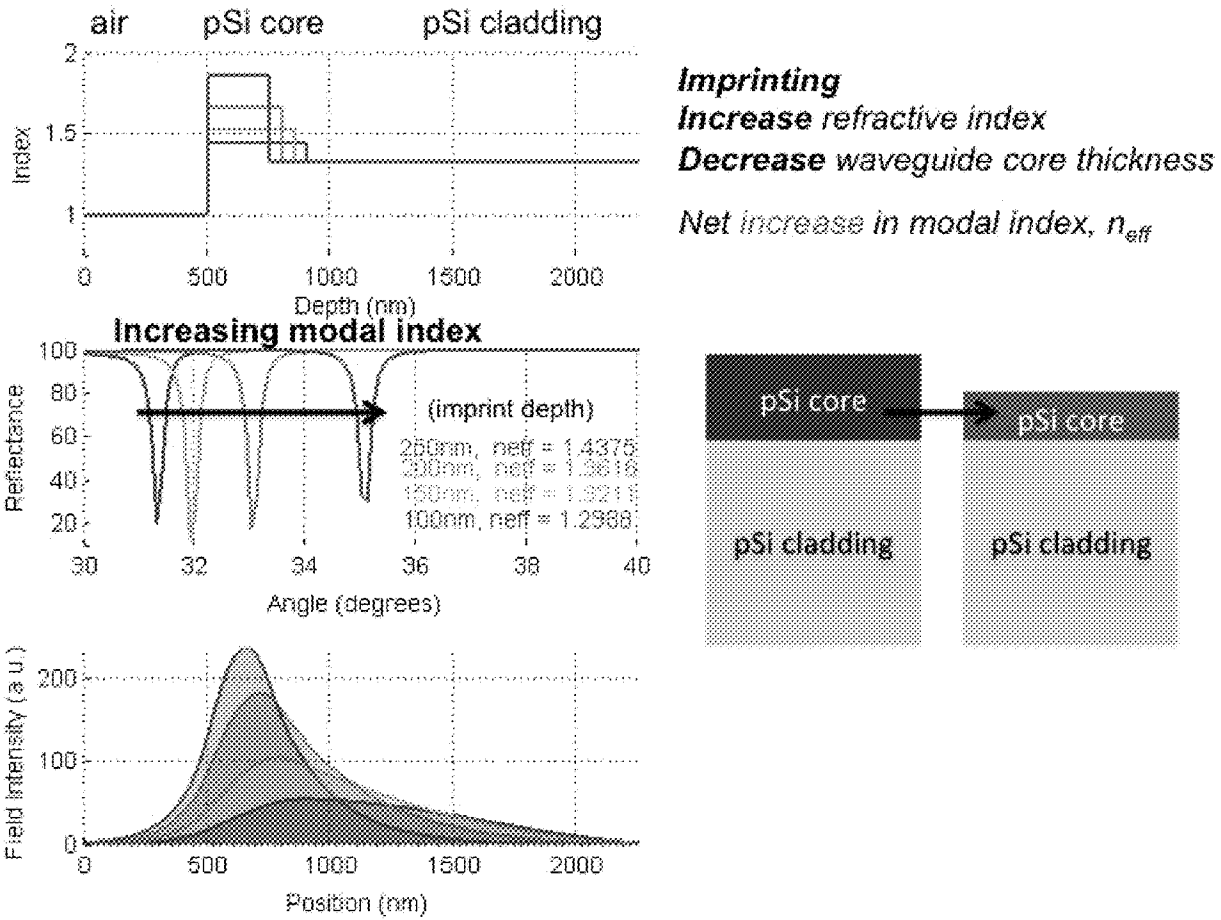
FIG. 7 shows the calculated variation in waveguide modal index for a gray-scale patterned pSi slab waveguide.

FIG. 4*b* shows tilt view SEM of a silicon stamp patterned with dome shaped, 3D curved structures. Performing gray-scale DIPS with such a stamp enables the replication of bowl shaped gradient index structures in pSi. The gradient optical thickness and smoothly curved pSi profile are readily observable under optical microscopy (FIG. 4*g*) and AFM (FIG. 4*l*). FIG. 6*b* shows a full AFM mapping of one of these structures. Based on AFM measurements and an initial ~2 μm film thickness, calculations (FIG. 2*f*) indicate that this particular structure contains porosities and refractive indices which smoothly vary from ~80% to 17% and ~1.32 to 3.1, respectively. The low-cost fabrication of devices with well-defined optical properties and 3D curvature is technologically important for realizing novel micro-optic devices. It may be possible to utilize gradient index pSi waveguides to rapidly and cheaply construct in-plane transformation optic devices such as multi-functional metadevices and optical cloaks. See, e.g., Gharghi et al., "A Carpet Cloak for Visible Light," (2011) Nano Lett. 11, 2825-2828; Valentine et al, "An optical cloak made of dielectrics," (2009) Nat. Mater. 8, 568-571; and Zentgraf et al., "An Optical "Janus" Device for Integrated Photonics," (2010) Adv. Mater. 22, 2561-2564, each of which is incorporated herein in its entirety by reference. Calculations (see, FIG. 7) confirm that imprinting can be used to arbitrarily tune the effective modal index of a pSi waveguide.

Example 6

Fabrication of Nano-Groves and Nano-Pits

The low-cost fabrication of nanoscaled metallic features, such as tips, grooves, or pits, is desirable for enabling applications spanning plasmonics, SERS, and label-free sensing. Thus, the application of gray-scale DIPS is investigated using a stamp containing sharp edge and tip patterns. SEM images of the fabricated stamps are shown in FIGS. 4*c-e*. Unlike stamps discussed previously, these sharply pointed stamps are fabricated by conventional EBL followed by isotropic reactive-ion etching (RIE). Imprinting into a ~160 nm thick np-Au film enables the replication of sharp 1D v-groove and 2D nano-pit arrays as shown in FIGS. 4*h* and 4*i*. FIG. 6*c* shows a full AFM mapping of one of these structures. Notably, these patterns represent the smallest features ever patterned into np-Au. AFM reveals that the v-grooves and pits are ~100 nm deep (FIG. 4*m*). The imprinted film fraction, ~0.68, is comparable to the initial porosity, indicating that np-Au can be locally densified into a nearly non-porous state. The ability to pattern sharp nanoscaled features, with <100 nm resolution, combined with the ability to dramatically and locally tune the effective dielectric function (FIGS. 3*a* and 3*b*), enables the plasmonic properties of np-Au to be tailored with improved freedom. See, e.g., Sondergaard et al., "Plasmonic black gold by adiabatic nanofocusing and absorption of light in ultra-sharp convex grooves," (2012) Nat. Commun. 3; and Lee et al., "Fabrication of the Funnel-shaped Three-Dimensional Plasmonic Tip Arrays by Directional Photofluidization Lithography," (2010) ACS Nano 2, 2465-2472, each of which is incorporated herein in its entirety by reference. Furthermore, as a direct-to-device technique, gray-scale DIPS enables these nanoscaled features to be replicated without the need for repeated lithography or etching steps.

Example 7

Fabrication of Well Defined "Cookie-Cutter" Microparticles

FIGS. 4*e* and 4*j* show that performing gray-scale DIPS with a sharp-edged stamp pattern enables 'cookie-cutter' pSi microparticles to be fabricated. In this example, the ~80% porosity pSi substrate is ~500 nm thick, resulting in pSi microparticles precisely tailored in size (e.g., 2×2×0.5 μm). These high porosity particles are relatively weakly attached to the underlying substrate and many are visibly removed with the stamp after imprinting. The remaining particles can be removed using an adhesive, an electrochemical lift-off step, or by brief sonication in liquid. Notably, with this particular stamp design, >90% areal packing density of highly monodisperse pSi microparticles can be achieved in a single step process. Such particles are particularly attractive for drug delivery and imaging applications. See, e.g., Tasciotti et al., "Mesoporous silicon particles as a multistage delivery system for imaging and therapeutic applications," (2008) Nat. Nanotechnol. 3, 151-157; and Park et al., "Biodegradable luminescent porous silicon nanoparticles for in vivo applications," (2009) Nat. Mater. 8, 331-336, each of which is incorporated herein in its entirety by reference. More advanced stamp designs could be used to tailor not only the size and shape of the particles, but also pattern the pore opening size or porosity within a given particle, enabling their optical and mechanical properties or drug loading and release kinetics to be altered.

We claim:

1. A patterned porous material comprising a three-dimensional surface at least a portion of which is non-linear, the porous material having an average pore size of less than about 1 μm, the three-dimensional surface having at least a first depth, a second depth, and a third depth, wherein the first depth, second depth and third depth are different from one another, wherein the non-linear portion of the three-dimensional surface has a curvilinear profile, and wherein the patterned porous material is mounted as only a single layer directly on a substrate.

2. The material of claim 1, the porous material having at least a first porosity at the first depth, a second porosity at the second depth, and a third porosity at the third depth, wherein the first porosity is greater than the second porosity and the second porosity is greater than the third porosity.

3. The material of claim 2, wherein the first porosity is from about 0.01% to about 95%, the second porosity is from about 0.01% to about 95%, and the third porosity is from about 0.01% to about 95%.

4. The material of claim 1, wherein the first depth is from about 1 nm to about 100 μm, the second depth is from about 1 nm to about 100 μm, and the third depth is from about 1 nm to about 100 μm.

5. The material of claim 1, wherein the patterned porous material comprises at least one of porous silicon, nanoporous gold, porous alumina, porous titanium dioxide, and mixtures thereof.

6. The patterned porous material of claim 1, wherein the curvilinear profile comprises at least one of a dome or a cone.

7. The material of claim 2, wherein the first depth is less than the second depth and wherein the second depth is less than the third depth.

8. The material of claim 1, wherein the substrate comprises at least one of silicon, glass, metal, quartz, plastic, polymers, and mixtures thereof.

9. A patterned porous material comprising a three-dimensional surface, the porous material having an average pore size of less than about 1 μm, the three-dimensional surface having at least a first depth, a second depth, and a third depth, wherein the first depth, second depth and third depth are different from one another, wherein the three-dimensional surface has a continuous profile, and wherein the patterned porous material is mounted as only a single layer directly on a substrate.

10. The material of claim 9, the porous material having at least a first porosity at the first depth, a second porosity at the second depth, and a third porosity at the third depth, wherein the first porosity is greater than the second porosity and the second porosity is greater than the third porosity.

11. The material of claim 10, wherein the first porosity is from about 0.01% to about 95%, the second porosity is from about 0.01% to about 95%, and the third porosity is from about 0.01% to about 95%.

12. The material of claim 9, wherein the first depth is from about 1 nm to about 100 μm, the second depth is from about 1 nm to about 100 μm, and the third depth is from about 1 nm to about 100 μm.

13. The material of claim 9, wherein the patterned porous material comprises at least one of porous silicon, nanoporous gold, porous alumina, porous titanium dioxide, and mixtures thereof.

14. The patterned porous material of claim 9, wherein the continuous profile comprises at least one of a gradient or a blazed structure.

15. The material of claim 10, wherein the first depth is less than the second depth and wherein the second depth is less than the third depth.

16. The material of claim 9, wherein the substrate comprises at least one of silicon, glass, metal, quartz, plastic, polymers, and mixtures thereof.

17. A patterned porous material comprising a three-dimensional surface, the porous material having an average pore size of less than about 1 μm, the three-dimensional surface having at least a first depth, a second depth, and a third depth, wherein the first depth, second depth and third depth are different from one another, and wherein the patterned porous material is mounted as only a single layer directly on a substrate.

18. The material of claim 17, the porous material having at least a first porosity at the first depth, a second porosity at the second depth, and a third porosity at the third depth, wherein the first porosity is greater than the second porosity and the second porosity is greater than the third porosity.

19. The material of claim 18, wherein the first depth is less than the second depth and wherein the second depth is less than the third depth.

20. The material of claim 17, wherein the patterned porous material comprises at least one of porous silicon, nanoporous gold, porous alumina, porous titanium dioxide, and mixtures thereof.

21. The material of claim 17, wherein the substrate comprises at least one of silicon, glass, metal, quartz, plastic, polymers, and mixtures thereof.

* * * * *